US005798476A

United States Patent [19]

Bailey

[11] Patent Number: 5,798,476

[45] Date of Patent: Aug. 25, 1998

[54] INITIATOR FOR AN AIR BAG INFLATOR

[75] Inventor: Todd R. Bailey, Higley, Ariz.

[73] Assignee: TRW Inc., Lyndhurst, Ohio

[21] Appl. No.: 621,441

[22] Filed: Mar. 25, 1996

[51] Int. Cl.[6] ..... F42C 19/12

[52] U.S. Cl. ..... 102/202.7; 102/202.9; 102/202.14

[58] Field of Search ..... 102/202.1, 202.2, 102/202.5, 202.7, 202.9, 202.14, 530, 531, 472; 280/741

[56] References Cited

U.S. PATENT DOCUMENTS

| | | | |
|---|---|---|---|
| 3,366,055 | 1/1968 | Hollander, Jr. | 102/202.7 |
| 3,686,934 | 8/1972 | Farrand et al. | 86/1.1 |
| 3,952,403 | 4/1976 | Copeland et al. | 437/206 |
| 3,960,083 | 6/1976 | Dietzel et al. | 102/202.7 |
| 3,974,424 | 8/1976 | Lee | 102/202.7 |
| 4,103,619 | 8/1978 | Fletcher et al. | 102/202.7 |
| 4,363,272 | 12/1982 | Simmons | 102/202.9 |
| 4,453,033 | 6/1984 | Duff et al. | 175/52 FP |
| 4,484,523 | 11/1984 | Smith et al. | 102/202.5 |
| 4,686,903 | 8/1987 | Wittwer | 102/202.5 |
| 4,708,060 | 11/1987 | Bickes, Jr. et al. | 102/202.7 |
| 4,729,315 | 3/1988 | Proffit et al. | 102/202.9 |
| 5,113,764 | 5/1992 | Mandigo et al. | 102/202.9 |
| 5,140,906 | 8/1992 | Little, II | 102/202.14 |
| 5,230,287 | 7/1993 | Arrel, Jr. et al. | 102/202.5 |
| 5,345,872 | 9/1994 | Takahashi et al. | 102/202.5 |
| 5,454,320 | 10/1995 | Hilden et al. | 102/202.7 |
| 5,544,585 | 8/1996 | Duguet | 102/202.5 |

FOREIGN PATENT DOCUMENTS

| | | | |
|---|---|---|---|
| 2945803 | 5/1981 | Germany | 102/202.5 |

*Primary Examiner*—Harold J. Tudor
*Attorney, Agent, or Firm*—Tarolli, Sundheim, Covell Tummino & Szabo

[57] ABSTRACT

An electrically actuatable initiator (10) for an air bag inflator (20) includes an ignition charge (190) which is ignitable by thermal energy from a resistive element (130). The resistive element (130) is formed on a substrate (110) as part of a chip (100). The chip (100) is secured to a header (40) by a portion (156, 158, 160, 162) of a glass to metal seal (150). The resistive element is electrically connected to terminals (60, 90) of the initiator (10) by brazing with braze preforms (170, 180). The brazed electrical connections are made during the same heating operation in which a glass preform is melted to form the mechanical connection provided by the glass to metal seal (150).

9 Claims, 3 Drawing Sheets

INITIATOR FOR AN AIR BAG INFLATOR

BACKGROUND OF THE INVENTION

1. Technical Field

The present invention relates to an apparatus for inflating an inflatable vehicle occupant device, and particularly relates to an electrically actuatable initiator for an air bag inflator. The present invention also relates to a method of manufacturing an electrically actuatable initiator for use in an inflator for an inflatable vehicle occupant device.

2. Description of the Prior Art

It is known to inflate an inflatable device, such as an air bag, to help protect a vehicle occupant in the event of an impact to the vehicle of a magnitude above a predetermined threshold. The air bag is inflated by inflation fluid from an inflator. The inflation fluid may be stored gas which is released from the inflator and/or gas generated by ignition of combustible gas generating material in the inflator.

The inflator uses an electrically actuatable initiator to open the container to release the stored gas and/or to ignite the gas generating material. The initiator typically includes a pyrotechnic ignition charge. The ignition charge may be ignitable by an electric resistance member which generates thermal energy upon actuation of the initiator.

SUMMARY OF THE INVENTION

The present invention is an electrically actuatable initiator for use in an air bag inflator. The initiator includes first and second electrical conductors for electrical connection with vehicle circuitry, and a support member. Glass insulator means connected with the support member supports the first electrical conductor in spaced relation to the second electrical conductor. An ignition charge is supported adjacent to the first and second electrical conductors and is ignitable by thermal energy. An insulator member is disposed adjacent to the ignition charge and to the first and second electrical conductors. A resistive element on the insulator member electrically connects the first and second electrical conductors. The resistive element, when electrically actuated by electric current flowing between the first and second electrical conductors, generates thermal energy to ignite the ignition charge. A glass member integral with the glass insulator means secures the insulator member to the support member.

The present invention is also an electrically actuatable initiator for use in an air bag inflator. The initiator includes first and second electrical conductors for electrical connection with vehicle circuitry, and means for supporting the electrical conductors in spaced relation to each other. An ignition charge is supported adjacent to the first and second electrical conductors and is ignitable by thermal energy. An insulator member is disposed adjacent to the ignition charge and to the first and second electrical conductors. A resistive element on the insulator member electrically connects the first and second electrical conductors. The resistive element, when electrically actuated by electric current flowing between the first and second electrical conductors, generates thermal energy to ignite the ignition charge. First and second braze preforms electrically connect by brazing the resistive element with the first and second electrical conductors, respectively.

The present invention is also a method of manufacturing an electrically actuatable initiator for use in an inflator for an inflatable vehicle occupant device. The method includes the steps of providing first and second electrical conductors for electrical connection with vehicle circuitry; providing a support member for the electrical conductors; supporting the electrical conductors in spaced relation to each other with a glass insulator means connected with the support member; providing a chip having an electrically insulating substrate and having a resistive element on the substrate for, when electrically actuated by electric current flowing between the first and second electrical conductors, generating thermal energy to ignite an ignition charge; and securing the chip to the support member with a glass member integral with the glass insulator means.

The present invention is also a method of manufacturing an electrically actuatable initiator for use in an inflator for an inflatable vehicle occupant device. The method comprises the steps of providing first and second electrical conductors for electrical connection with vehicle circuitry; supporting the electrical conductors in spaced relation to each other; providing a chip having an electrically insulating substrate and having a resistive element on the substrate for, when electrically actuated by electric current flowing between the first and second electrical conductors, generating thermal energy to ignite an ignition charge; and electrically connecting the first and second electrical conductors to the resistive element by brazing with first and second braze preforms, respectively.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
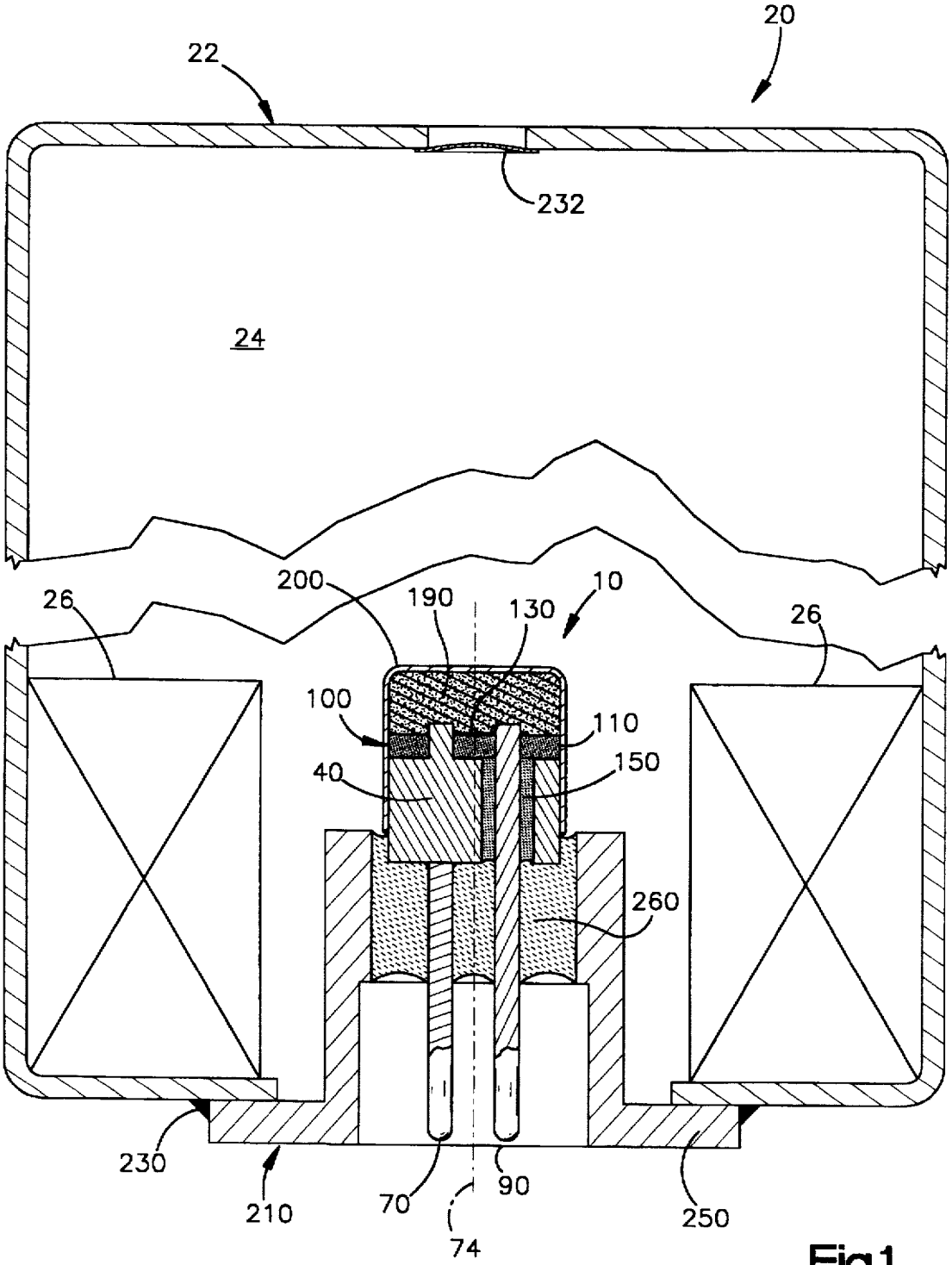
FIG. 1 is a schematic sectional view of an inflator including an initiator constructed in accordance with the present invention.

The present invention relates to an electrically actuatable initiator and, preferably, to an initiator for an inflator for an inflatable vehicle occupant device such as an air bag. The present invention is applicable to various initiator constructions, including initiators for inflators with different modes of operation. For example, the invention can be applied to initiators for inflators which release gas from a container and/or which generate gas by ignition of combustible gas generating material. As representative of the present invention, FIG. 1 illustrates an initiator 10 constructed in accordance with the present invention.

The initiator 10 is included in an inflator illustrated schematically at 20. The inflator 20 includes a container 22 which defines a chamber 24 within the inflator 20. A body of pyrotechnic material indicated schematically at 26 is disposed within the chamber 24. A quantity of gas such as argon or nitrogen is also disposed within the chamber 24 in the container 22. The gas is stored under pressure in the chamber 24.

The initiator 10 (FIGS. 2–4) includes a support member or header 40 which is a generally cylindrical metal block preferably made from powder metal processed 304L stainless steel. The header 40 has a cylindrical outer side surface 42 which extends parallel to a central axis 74 of the initiator 10. The header 40 has planar, radially extending, circular inner and outer end surfaces 44 and 46. An inner surface 48 defines a cylindrical opening 50 extending axially through the header 40 between the end surfaces 44 and 46.

A terminal post 60 projects axially from the inner end surface 44 of the header 40. The terminal post 60 is preferably formed as one piece with the header 40. The terminal post 60 has a cylindrical outer surface 62 (FIG. 3) and a planar, radially extending end surface 64.

A first conductor pin or terminal 70 (FIG. 2) is connected with the header 40. The first terminal 70 is a metal pin preferably made from drawn nickel-iron alloy wire. The first terminal 70 has a cylindrical outer surface 72 which extends parallel to the central axis 74 of the initiator 10. An inner end portion 76 of the first terminal 70 is secured by brazing with a braze preform 78 to the outer end surface 46 of the header 40. An outer end portion 80 of the first terminal 70 extends away from the header 40 in a direction parallel to the axis 74.

A second conductor pin or terminal 90 extends parallel to the first terminal 70. The second terminal 90 is made from the same material as the first terminal 70. The second terminal 90 has a cylindrical outer surface 92 which extends parallel to the axis 74. An inner end portion 94 of the second terminal 90 projects axially from the opening 50 above (as viewed in FIG. 3) the inner end surface 44 of the header 40.

An inner end surface 96 of the second terminal 90 is disposed above the inner end surface 44 of the header 40. The inner end surface 96 of the second terminal 90 is coplanar with the inner end surface 64 of the terminal post 60. An intermediate portion 98 of the second terminal 90 extends through the opening 50 in the header 40. An outer end portion 99 (FIG. 2) of the second terminal 90 extends away from the header 40 in a direction parallel to the axis 74.

The initiator 10 includes a chip 100 (FIGS. 2 and 3) for electrically interconnecting the first and second terminals 70 and 90. The chip 100 includes a substrate 110 (FIG. 3) formed of an electrically insulating material. The substrate 110 is preferably formed of a ceramic material such as dense 96% alumina ($Al_2O_3$), beryllia (BeO) or steatite. The substrate 110 has a disc-shaped configuration including planar, radially extending inner and outer end surfaces 112 and 114. An axially extending, cylindrical outer side surface 116 of the substrate 110 is concentric with and has the same diameter as the cylindrical outer side surface 42 of the header 40.

A first opening 118 in the substrate 110 extends axially between the end surfaces 112 and 114 of the substrate 110. The terminal post 60 of the header 40 extends through the first opening 118. A second opening 120 in the substrate 110 extends axially between the end surfaces 112 and 114 of the substrate. The inner end portion 94 of the second terminal 90 extends through the second opening 120 in the substrate 110.

The chip 100 includes a resistive element 130 disposed on the substrate 110. The resistive element 130 is made of a known material which heats up and generates thermal energy when an electric current of a predetermined magnitude passes through the resistive element. The resistive element 130 may be made from, for example, nickel-chrome, phosphorous-chrome, or tantalum nitride. The resistive element 130 is formed on the inner end surface 112 of the substrate 110 in a known manner, for example, by thin film metal alloy deposition or by another known technique of semiconductor fabrication.

Figure 4:
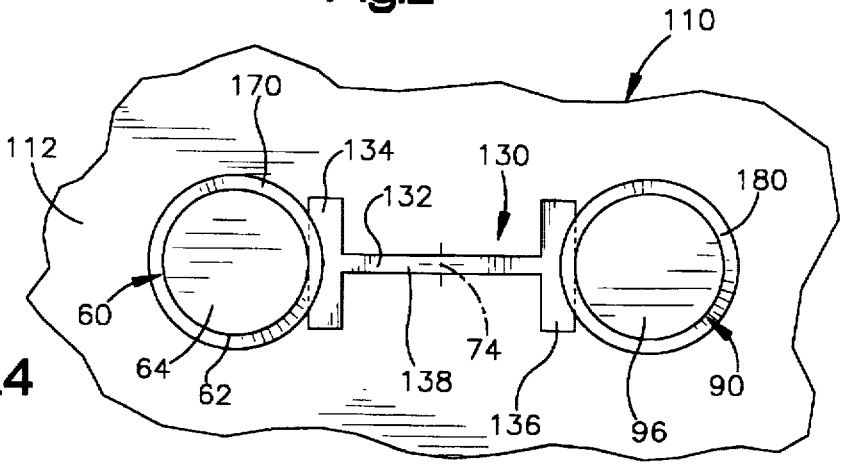
FIG. 4 is a view taken along line 4—4 of FIG. 3.

The resistive element 130 has an H-shaped configuration when viewed in an axial direction, that is, as seen in FIG. 4. A central portion 132 of the resistive element 130 extends between first and second opposite end portions 134 and 136. The first end portion 134 of the resistive element 130 is disposed adjacent to the first opening 118 (FIG. 3) in the substrate 110. The second end portion 136 of the resistive element 130 is disposed adjacent to the second opening 120 in the substrate 110. The resistive element 130 has parallel, radially extending inner and outer surfaces 138 and 140. The outer surface 140 of the resistive element 130 is disposed in abutting engagement with the inner end surface 112 of the substrate 110.

A first glass to metal seal, or glass seal, 150 interconnects the second terminal 90, the header 40, and the chip 100. The first glass seal 150, formed in a manner described below, has a main body portion 152 which encircles the intermediate portion 98 of the second terminal 90. The main body portion 152 has an opening 154 through which the intermediate portion 98 of the second terminal 90 extends. The main body portion 152 of the first glass seal 150 fills the annular space between the intermediate portion 98 of the second terminal 90 and the inner surface 48 of the header 40. The main body portion 152 seals around and structurally supports the second terminal 90 and electrically insulates between the header 40 and the second terminal 90.

The first glass seal 150 also has a connector portion 156 for securing the chip 100 to the header 40. The connector portion 156 of the first glass seal 150 is formed as one piece with the main body portion 152 of the first glass seal. The connector portion 156 includes a thin, planar, layer 158 (FIG. 3) of the material of the first glass seal 150. The layer 158 extends between the inner end surface 44 of the header 40 and the outer end surface 114 of the substrate 110. The layer of glass material 158 extends radially outward from the main body portion 152 of the first glass seal 150, in a direction toward and extending to the outer side surface 42 of the header 40.

The connector portion 156 of the first glass seal 150 also includes an annular first portion or segment 160 which extends axially from the outer periphery of the layer 158 in a direction toward the inner end surface 112 of the substrate 110. The segment 160 extends along and overlies a portion of the outer peripheral surface 116 of the substrate 110. An annular second portion or segment 162 of the connector portion 156 of the first glass seal 150 extends axially from the outer periphery of the layer 158, in a direction away from the substrate 110. The second segment 162 of the connector portion 160 extends along and overlies a portion of the outer peripheral surface 42 of the header 40.

The intermediate layer 158 and the segments 160 and 162 of the first glass seal 150 cooperate to secure the chip 100 to the header 40. The intermediate layer 158 bonds the chip 100 to the header 40. The segments 160 and 162 of the connector portion 156 of the first glass seal 150 exert a radially inwardly directed clamping force on the assembly of the chip 100 and the header 40. This clamping force helps to secure the chip 100 to the header 40.

The configuration of the resistive element 130 on the chip 100 is selected so that, when the chip is assembled to the header 40, the first end portion 134 of the resistive element is disposed adjacent to the terminal post 60 of the header 40. The first end portion 134 and the terminal post 60 may be, but are not necessarily, in abutting engagement. The second end portion 136 of the resistive element 130 is disposed adjacent to the inner end portion 94 of the second terminal 90. The second end portion 136 and the inner end portion 94 may be, but are not necessarily, in abutting engagement.

The first end portion 134 of the resistive element 130 and the terminal post 60 are electrically interconnected by brazing with a first braze preform 170. The first braze preform 170 can be made from many different materials but is typically an electrically conductive metal alloy including copper and silver, for example. The first braze preform 170 is a ring-shaped member which extends around the terminal post 60 and which is wide enough to bridge any gap between the terminal post and the first end portion 134 of the resistive element 130. When heated to about 1,000° C., in a manner described below, the first braze preform 170 melts or reflows to braze together the terminal post 160 and the first end portion 134 of the resistive element 130. The first braze preform 170, because it is electrically conductive, thus places the resistive element 130 in electrical contact with the terminal post 60 of the header 40.

A second braze preform 180 electrically interconnects the second end portion 136 of the resistive element 130 and the inner end portion 94 of the second terminal 90. The second braze preform 180 is preferably made from the same material as the first braze preform 170. The second braze preform 180 is a ring-shaped member which extends around the inner end portion 94 of the second terminal 90 and which is wide enough to bridge any gap between the second terminal and the second end portion 136 of the resistive element 130. When heated to about 1,000° C., in a manner described below, the second braze preform 180 melts to braze together the second terminal 90 and the second end portion 136 of the resistive element 130. The second braze preform 180, because it is electrically conductive, thus places the resistive element 130 in electrical contact with the second terminal 90.

The initiator 10 includes an ignition charge 190 (FIG. 2) which is ignitable by the resistive element 130. The ignition charge 190 is a pyrotechnic material, such as zirconium potassium perchlorate, which auto-ignites upon the application of sufficient thermal energy. The ignition charge 190 overlies and is in abutting engagement with the inner end surface 112 of the substrate 110 of the chip 100. The ignition charge 190 also overlies and is in abutting engagement with the resistive element 130. The chip 100 thus acts as a support for the ignition charge 180.

Figure 2:
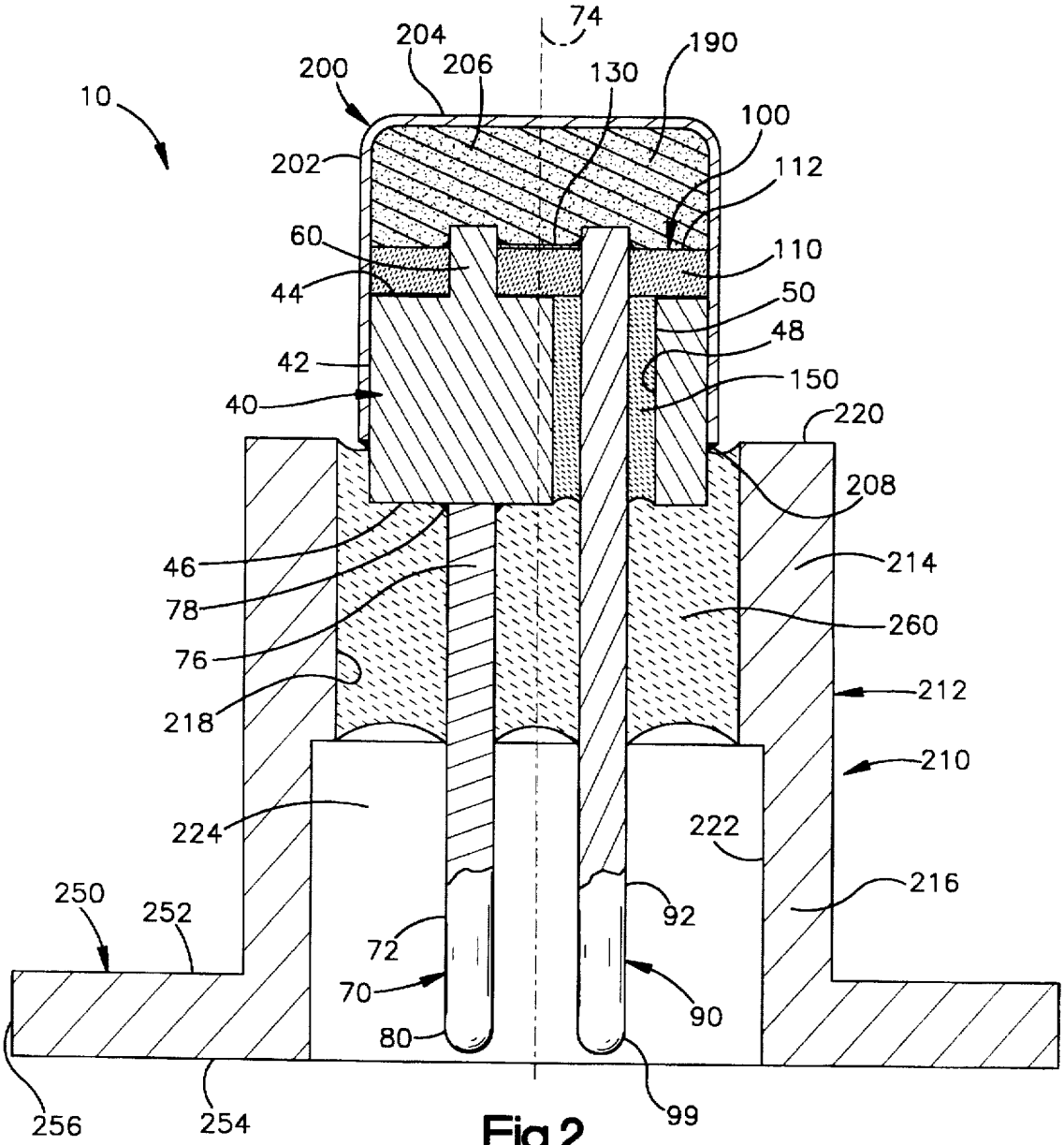
FIG. 2 is an enlarged sectional view of the initiator of FIG. 1.
Figure 3:
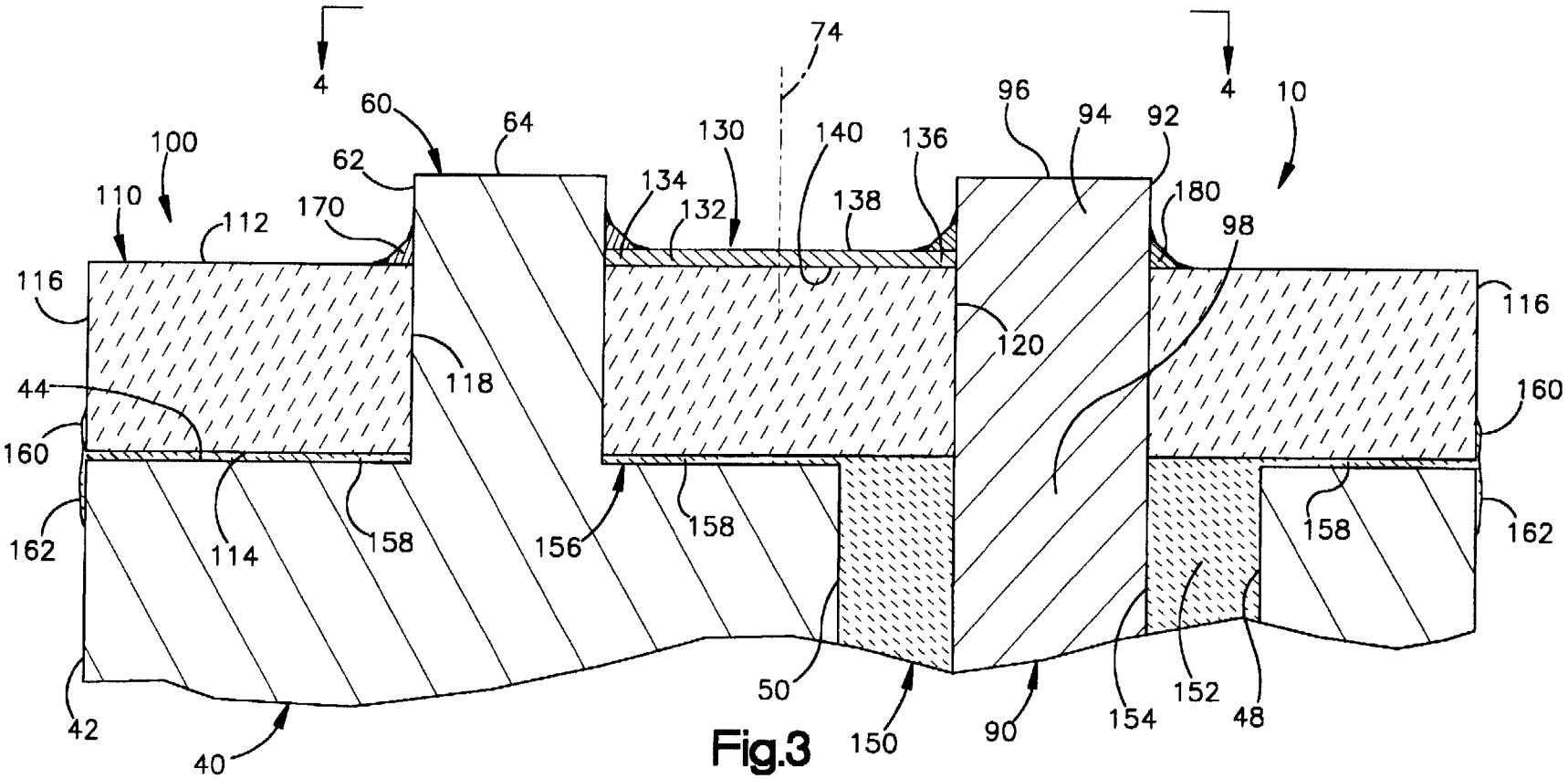
FIG. 3 is a further enlarged view of a portion of the initiator of FIG. 2 with parts removed.

The ignition charge 190 is enclosed in an ignition cup 200 (FIG. 2). The ignition cup 200 is a cup-shaped metal member preferably made from drawn 304L stainless steel. The ignition cup 200 includes a cylindrical side wall 202 and a circular end wall 204 formed as one piece with the side wall. The walls 202 and 204 of the ignition cup 200 define a cavity 206 in which the ignition charge 190 is disposed. The side wall 202 of the ignition cup 200 overlies a portion of the cylindrical outer surface 42 of the header 40. The side wall 202 of the ignition cup 200 is welded to the header 40 at a circumferential weld location 208.

The initiator 10 also includes a retainer 210 (FIGS. 1 and 2), which is preferably made from machined or metal injection molded 304L stainless steel. A cylindrical side wall 212 (FIG. 2) of the retainer 210 has an inner end portion 214 and an outer end portion 216. The inner end portion 214 of the side wall 212 has an axially extending, cylindrical inner surface 218 and an annular, radially extending, inner end surface 220. The outer end portion 216 of the retainer 210 has a cylindrical inner surface 222 which extends parallel to the axis 74. The inner surfaces 222 and 218 of the retainer 210 define a passage 224 extending axially through the retainer and through which both terminals 70 and 90 extend.

An annular flange 250 of the retainer extends radially outward from the outer end portion 216. The flange 250 has parallel radially extending inner and outer side surfaces 252 and 254 and an axially extending outer peripheral surface 256.

A second glass-to-metal seal 260 (FIG. 2) interconnects the retainer 210, the header 40, and the terminals 70 and 90. The second glass seal 260 is formed in a known manner and fuses to the inner side surface 218 of the side wall 212 of the retainer 210 to create a compression seal between the second glass seal and the retainer. The second glass seal 260 seals against and structurally supports the header 40 and the terminals 170 and 190. It should be understood that the retainer 210 and the header 40 can be secured together by means other than the second glass seal 260, for example, by welding.

The initiator 10 is attached to the container 22 (FIG. 1), preferably by welding. The flange 250 of the retainer 210 is continuously welded to the container 22 at a circumferential weld location 230. The initiator 10 is thereby secured in position in the inflator 20. The initiator 10 projects into the chamber 24 in the container 22 and is exposed to the pressure of the gas stored in the chamber 22. It should be noted that the initiator 10 can be secured to the container 22 by other means. For example, it is contemplated that the retainer 210 and container 22 may have complementary threaded portions which would permit the retainer and cover to be screwed together.

In fabrication of the initiator 10, the header 40, the terminals 70 and 90, and the chip 100 are positioned in a fixture (not shown) suitable for maintaining them in the correct relative positions during a subsequent heating step. A ground, pressed glass preform, for forming the first glass seal 150, is placed within the annulus between the outer surface of the intermediate portion 98 of the second terminal 90 and the inner surface 48 of the header 40. In addition, the braze preforms 78, 170 and 180 are assembled in their respective positions on the initiator 10.

This assembly, including the glass preform for forming the first glass seal 150 and the braze preforms 78, 170, and 180, is then heated in a furnace to a temperature, typically about 1,000° C., at which the glass preform and the braze preforms melt or reflow. The assembly is then allowed to cool.

The melted glass material of the glass preform, when it cools, forms the first glass seal 150. Most of the glass material remains in the annulus between the outer surface of the intermediate portion 98 of the second terminal 90 and the inner surface 48 of the header 40, forming the main body portion 152 of the first glass seal 150.

Some of the glass material, when melted, flows out of the opening 50 in the header 40 and flows between the outer end surface 44 of the header 40 and the inner end surface 114 of the substrate 110 of the chip 100. The glass layer 158 is formed as this molten glass flows radially outwardly, by capillary action, from the main body portion 152 of the first glass seal 150 in a direction toward and extending to the outer periphery 42 of the header 40. The assembly is fixtured during this heating step so that a small portion of the glass material also flows axially along the outer peripheral surface 42 of the header 40, and along the outer peripheral surface 116 of the substrate 110 of the chip 100, to form the segments 160 and 162 of the connector portion 156 of the first glass seal 150. When the glass material cools, the first glass seal 150 is formed and the chip 100 is secured to the header 40.

At the same time as the first glass seal 150 is being formed, the braze preform 78 is being heated in the furnace so that it melts or reflows to electrically connect the first terminal 70 with the header 40 by brazing. Also at the same time, the first and second braze preforms 170 and 180 are being heated in the furnace so that they melt or reflow to connect electrically by brazing the terminal post 60 and the second terminal 90, respectively, to the resistive element 130. This heating of the braze preforms 78, 170, and 180 is performed at the same time as the heating of the glass preform. When the braze preform 78 cools, the first terminal 70 is mechanically and electrically connected with the header 40. When the braze preforms 170 and 180 cool, the resistive element 130 is electrically connected with the terminal post 60 and with the second terminal 90.

The braze preforms 170 and 180 melt to fill any gaps between the resistive element 130, on the one hand, and the terminal post 60 and the second terminal 90 on the other hand. Thus, the terminal post 60 and the second terminal 90 need not be precision ground or otherwise formed to make direct physical contact with the resistive element 130. Likewise, the resistive element 130 need not be precision etched or otherwise formed to make direct physical contact with the terminal post 60 and the second terminal 90. As a result, the second terminal 90 can be made from low cost commercially available round wire stock, and the chip 100 can be made in a relatively low cost commercially available process. Also, extremely precise relative positioning of the chip 100 and the other parts of the initiator 10, during the heating process, is not needed.

The use of the braze preforms 170 and 180 also eliminates the need for additional parts such as thin bonding wires in making the electrical connections to the chip 100. The chip 100 thus provides a rigid and flat structure upon which the ignition charge 190 can be pressed, without deforming critical suspended electrical interconnections such as thin bonding wires or a bridgewire.

The braze preforms 78, 170 and 180 are made from a material which reflows at substantially the same temperature as the glass preform used for making the first glass seal 150. During the heating process described above, the electrical bonds in the initiator 10, which are effected by the braze preforms 78, 170 and 180, are made simultaneously with the mechanical bond which is effected by the first glass seal 150. Only one common temperature in one common heating is needed to reflow both the braze preforms 78, 170 and 180 and the glass preform for the first glass seal 150.

After the above described step of securing the chip 100 to the header 40, the remaining parts of the initiator 10, including the ignition charge 190, the ignition cup 200, the retainer 210, and the second glass seal 260, are assembled to the header 40. The initiator 10 is assembled in the inflator 20 and the inflator 20 is mounted in a vehicle. The terminals 70 and 90 of the initiator 10 are connected with vehicle circuitry (not shown) for use in inflating an inflatable device such as an air bag. The vehicle circuitry includes a power source, which is preferably the vehicle battery and/or a capacitor, and a normally open switch. The switch is part of a sensor which senses a condition indicating the occurrence of a vehicle collision . The collision-indicating condition may be, for example, sudden vehicle deceleration caused by a collision.

If the collision-indicating condition is above a predetermined threshold, it indicates the occurrence of a collision for which inflation of the air bag is desired to protect an occupant of the vehicle. The sensor then closes the switch, and an electric current flows through the terminals 70 and 90. The electric current flows through a circuit which includes the first terminal 70, the header 40, the terminal post 60, the first braze preform 170, the resistive element 130, the second braze preform 180, and the second terminal 90.

The resistive element 130 heats up because of the electric current flowing through it and ignites the ignition charge 190. The ignition charge 190 ignites the pyrotechnic material 26 in the container 22. The pyrotechnic material 26 generates gas for inflating the air bag (not shown). The ignition of the ignition charge 190 also results in rupturing of a burst disk 232 of the container 22 to release the gas stored in the container. The gas stored in the container 22, heated and augmented by the gas generated by the pyrotechnic material 26, is directed into the air bag (not shown) to inflate the air bag.

From the above description of the invention, those skilled in the art will perceive improvements, changes and modifications in the invention. Such improvements, changes and modifications within the skill of the art are intended to be covered by the appended claims.

Having described the invention, I claim:

1. An electrically actuatable initiator for use in an inflator for an inflatable vehicle occupant device, said initiator comprising:

first and second electrical conductors for electrical connection with vehicle circuitry;

a header having an end surface, said first electrical conductor extending through said header;

glass insulator means connected with said header for supporting said first electrical conductor in spaced relation to said header and to said second electrical conductor;

an ignition charge supported adjacent to said first and second electrical conductors and ignitable by thermal energy;

an insulator member disposed on said header adjacent to said ignition charge and to said first and second electrical conductors;

a resistive element on said insulator member, said insulator member being disposed intermediate said resistive element and said end surface of said header, said resistive element electrically connecting said first and second electrical conductors for, when electrically actuated by electric current flowing between said first and second electrical conductors, generating thermal energy to ignite said ignition charge; and a glass member integral with said glass insulator means for securing said insulator member to said end surface of said header;

wherein said glass member has a first portion which extends between and bonds together a surface of said insulator member and said end surface of said header, said glass member having a second portion which overlies outer peripheral surfaces of said insulator member and said header.

2. An initiator as set forth in claim 1 wherein said resistive element comprises a metal member formed on said insulator member by thin film metal deposition.

3. An initiator as set forth in claim 1 wherein said glass insulator means and said glass member comprise portions of a glass to metal seal of said initiator.

4. An initiator as set forth in claim 1 wherein said header is made from metal and has a cylindrical outer surface and said insulator member has a cylindrical outer surface, said surface of said insulator member and said end surface of said header comprising adjacent, radially extending planar surfaces of said insulator member and said header, said first portion of said glass member comprising a layer of glass extending radially between said planar surfaces of said insulator member and said header, said second portion of said glass member comprising an annular, axially extending body of glass overlying said cylindrical surfaces of said insulator member and said header and clamping said insulator member to said header.

5. An initiator as set forth in claim 1 including first and second braze preforms electrically connecting by brazing said resistive element with said first and second electrical conductors, respectively.

6. An initiator as set forth in claim 5 wherein each one of said first and second braze preforms comprises a metal alloy which reflows at a first temperature to electrically interconnect said resistive element with said first and second electrical conductors.

7. An initiator as set forth in claim 6 wherein said glass insulator means and said glass member comprise portions of a glass to a metal seal made from a glass preform which reflows at said first temperature to mechanically interconnect said insulator member with said header.

8. An electrically actuatable initiator for use in an inflator for an inflatable vehicle occupant device, said initiator comprising:

a metal header having an end surface;

first and second electrical conductors having end portions projecting from said end surface of said header, said first electrical conductor extending through said header;

a chip including an electrically insulating base and a conductive element on said base, said electrically insulating base of said chip being disposed on said end surface of said header;

means for electrically connecting said conductive element of said chip between said conductor end portions; and a first glass seal member;

said first glass seal member having a first part which is at least partially disposed between said first electrical conductor and said header and which supports said first electrical conductor relative to said header and which insulates electrically between said first electrical conductor and said header;

said first glass seal member having a second part comprising a layer which is thinner than said base and which is thinner than said header, which is at least partially disposed between said electrically insulating base of said chip and said end surface of said header and which bonds said chip to said end surface of said header;

said second part of said first glass seal member further comprising an annular, axially extending body of glass overlying outer peripheral surfaces of said base and said header and clamping said base to said header.

9. An initiator as set forth in claim 8 wherein said metal header has a cylindrical outer surface and said chip base has a cylindrical outer surface, first and second opposed surfaces of said insulator member and said header comprising said end surface of said header and an adjacent, radially extending planar surface of said base, said layer extending radially between said end surface of said header and said planar surface of said base, said second part of said first glass seal member comprising first and second annular segments of said first glass seal member extending axially in opposite directions from said layer.

* * * * *